US005190369A

United States Patent [19]

Pace

[11] Patent Number: 5,190,369

[45] Date of Patent: Mar. 2, 1993

[54] TROUBLELIGHT ATTACHMENT FOR FLASHLIGHT

[76] Inventor: Stan D. Pace, 826 N. Union, Loudonville, Ohio 44842

[21] Appl. No.: 825,060

[22] Filed: Jan. 24, 1992

[51] Int. Cl.[5] ..... F21L 15/02

[52] U.S. Cl. ..... 362/186; 362/208; 362/376

[58] Field of Search ..... 362/186, 185, 202, 208, 362/376

[56] References Cited

U.S. PATENT DOCUMENTS

| | | | |
|---|---|---|---|
| 1,648,709 | 11/1927 | Winsel | 362/186 |
| 2,092,664 | 9/1937 | Bray | 362/186 |
| 2,371,775 | 3/1945 | Pope | 362/186 |
| 2,460,173 | 1/1949 | Halbing | 362/376 |
| 3,114,143 | 12/1963 | Robinson | 362/186 |
| 3,244,873 | 4/1966 | Leutheuser | 362/376 |
| 3,383,675 | 5/1968 | Allardice et al. | 362/186 |
| 4,004,132 | 1/1977 | Glass et al. | 362/186 |
| 4,042,919 | 8/1977 | Patty | 362/186 |
| 4,141,062 | 2/1979 | Trueblood | 362/186 |
| 4,257,085 | 3/1981 | Kimmel | 362/186 |
| 4,369,487 | 1/1983 | Carlow | 362/376 |
| 4,388,674 | 6/1983 | Sano | 362/186 |
| 4,428,034 | 1/1984 | Seller | 362/186 |
| 4,739,457 | 4/1988 | Orr | 362/287 |

FOREIGN PATENT DOCUMENTS

| | | | |
|---|---|---|---|
| 521613 | 5/1940 | United Kingdom | 362/186 |

*Primary Examiner*—Richard R. Cole
*Attorney, Agent, or Firm*—Jerry Semer

[57] ABSTRACT

The invention is a device that attaches to a flashlight and makes the flashlight a cordless trouble-light. The invention consists of an outer cylindrical shell with a closed top and open bottom. The open bottom is threaded so that it can be screwed onto the lamp of a flashlight so designed for this concept. In the front of the cylindrical shell is a clear window. Within the shell and behind the clear window is a mirror that is adapted so that when the light source from the flashlight shines upon the mirror, the mirror reflects toward the clear window. A plastic snap-on shield is placed over the clear window for protection. The snap-on shield can be removed for easy cleaning of the window.

10 Claims, 2 Drawing Sheets

TROUBLELIGHT ATTACHMENT FOR FLASHLIGHT

FIELD OF THE INVENTION

This invention relates to a device that is attachable to a flashlight. The device converts the flashlight into a portable, cordless, shockproof troublelight.

BACKGROUND OF THE INVENTION

Often when working alone, difficulties arise when trying to position a common flashlight. A major problem with the typical troublelight is the availabilty of a power source. The cumbersome and oftentimes dangerous extension cord places a limit on said power source. "Cordless troublelight freedom" is the major purpose of the invention. The concept eliminates the prospects of extension cord damage, overheating and the possibility of electrocution and/or explosion.

Another objective of the invention is to offer "cordless troublelight freedom" to other fields of use: Aquatic—when the concept is attached to a waterproof flashlight, the invention provides a safe troublelight near and even under water. Another benefit of this particular light being floatable and highly reflective is that it could be indispensable in emergency situations such as search and rescue at sea.

The self-contained troublelight can be also be beneficial aboard ship, aircraft, or spacecraft where there is a limited power source or where the power source must be greatly conserved.

Another objective of the invention is to provide a simplified means of attaching the unit as a cordless troublelight in order to illuminate the work area. Mounted on top of the invention is a powerful magnet containing a "recessable" swivel hook. When the hook is flipped to the "up" position, it can be hooked to objects. When in the "down" position, the hook is "recessed" so that it does not interfere with the holding power of the magnet. On the back of the invention, another powerful magnet is mounted to aid in the positioning of the troublelight.

SUMMARY OF THE INVENTION

The invention is a device that attaches to a flashlight and makes said flashlight a cordless trouble-light. The invention consists of an outer cylindrical shell with a closed top and open bottom. The open bottom is threaded so that it can be screwed onto the lamp of a flashlight so designed for this concept. In the front of the cylindrical shell is a clear window. Within said shell and behind said clear window is a mirror that is adapted so that when the light source from the flashlight shines upon the mirror, the mirror reflects toward the clear window. A plastic snap-on shield is placed over the clear window for protection. The snap-on shield can be removed for easy cleaning of said window.

DETAILED DESCRIPTION OF THE PREFERRED EMBODIMENT

Figures 2, 3:
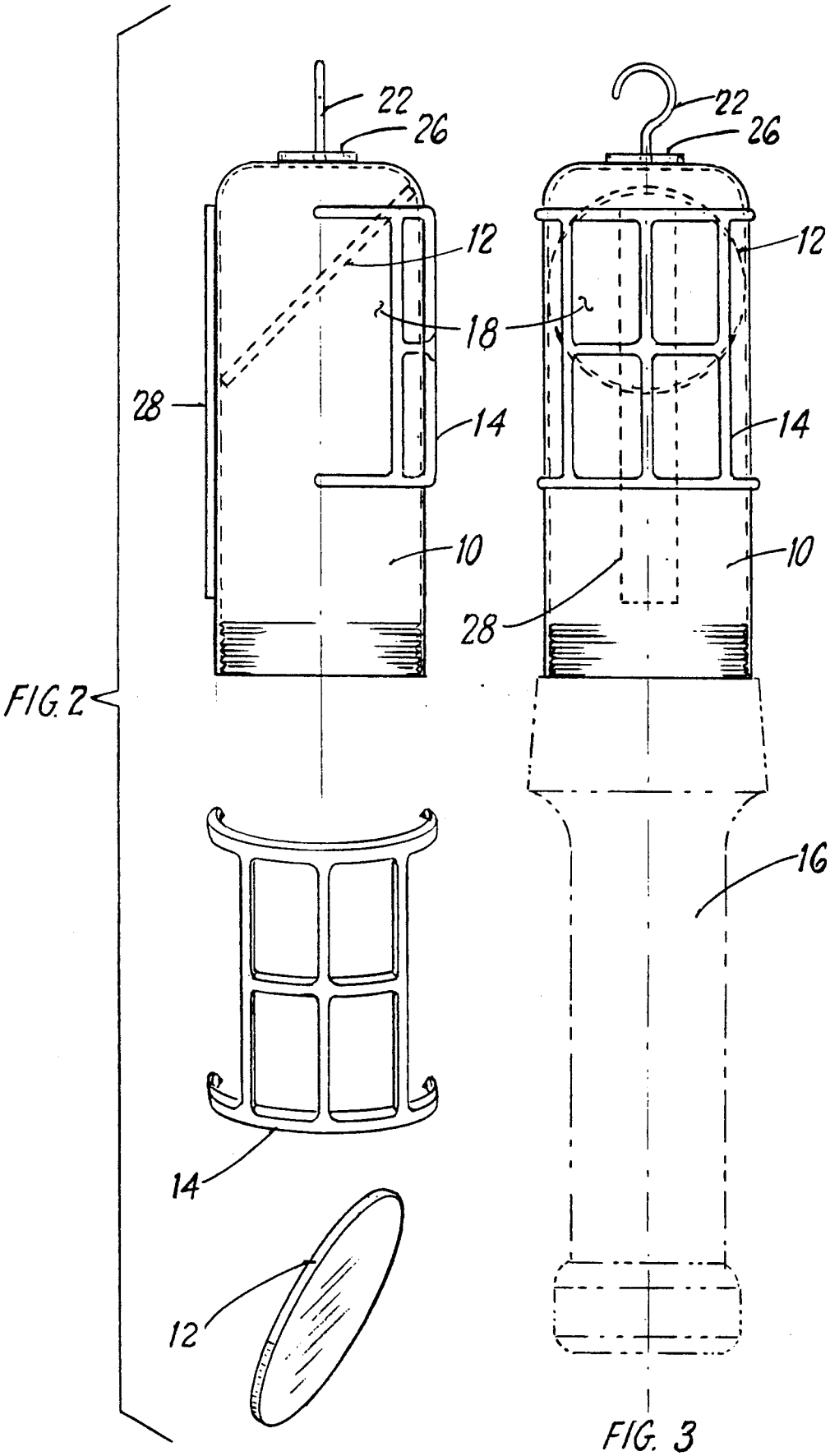
FIG. 2 is an exploded view of the invention.
FIG. 3 is a front view of the invention with a flashlight attached to the invention in phantom.

FIG. 2 illustrates an exploded view of the invention. The shell 10 is cylindrical in nature with a closed top and open bottom. Within the shell 10 and attached to shell 10 is a mirror 12. A shield 14 is adapted to be attached to shell 10. In the preferred embodiment, shield 14 is adapted to be releaseably attached to shell 10.

FIG. 3 shows a front view of the invention. It shows that a flashlight 16 can be attached to shell 10. In the preferred embodiment, shell 10, the open bottom is threaded so that it can be attached to flashlight 16. However, there are many other ways known in the art, including frictionally attaching to attach shell 10 to a flashlight 16. FIG. 3 shows a clear window 18 in the front of the shell 10. The mirror 12 is attached to the shell 10 in such a way that the light from the flashlight 16 will shine upon the mirror 12 and reflect toward window 18. In the preferred embodiment, mirror 12 is a flat mirror that is attached within shell 10 at 45 degrees so that the light from the flashlight 16 will reflect upon the mirror 12 and be directed out of window 18.

Figure 4:
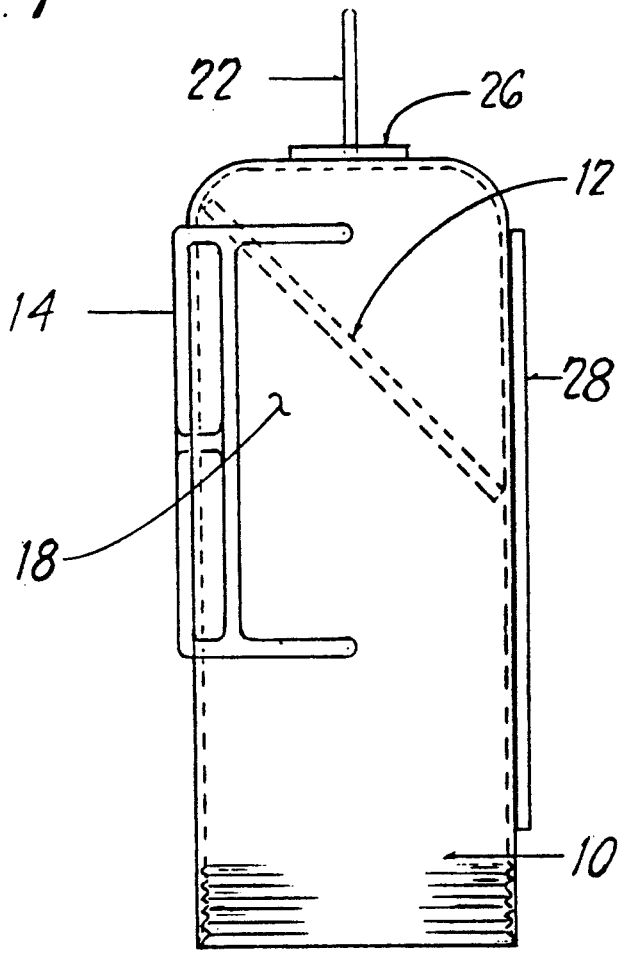
FIG. 4 is a side view of the invention.

FIG. 4 shows in phantom, the mirror 12 and how it's attached at the 45 degree angle. FIG. 3 shows the shield 14 which is attached to the front of the shell 10 and protects the window 18. The above mentioned concept could be designed with a permanent protective shield 14 mounted on hinges to swing clear for easy cleaning of said window 18. In the preferred embodiment, the shield 14 is basically of a cross-hatch design. Affixed to the back of the shell 10 is a powerful magnet 28 which allows the invention with the flashlight 16 installed to be attached to iron or steel surfaces.

Figure 1:
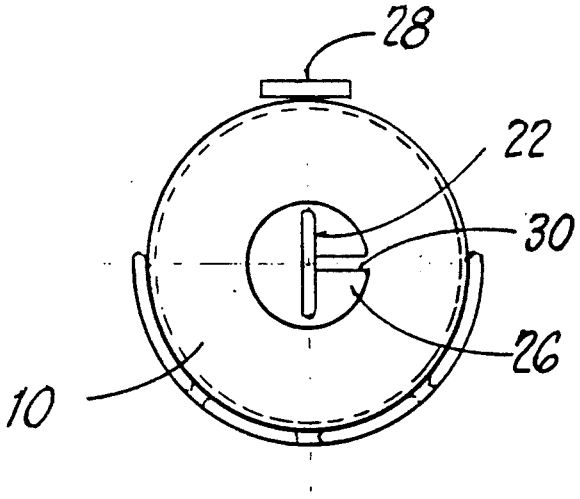
FIG. 1 is a top view of the invention.
Figure 5:
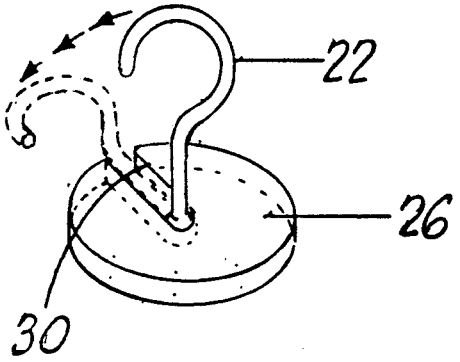
FIG. 5 is a working view of the top hook and magnet assembly.

FIG. 5 shows the hook 22 assembly. The hook 22 can be either in the down position as shown in phantom in FIG. 5, or in the up position as shown in FIGS. 1, 2, 3, 4, 5. When the hook 22 is in the up position, it can be attached to most surfaces having strength enough to hold the invention with the flashlight attached. When hook 22 is in the down position, it fits in the notch 30 in top magnet and does not interfere with the use of said top magnet 26, allowing it to be affixed to iron or steel surfaces. FIG. 1 also shows magnet 26 which is attached to the top of the shell 10.

Changes in this specifically described embodiment can be carried out without departing from the scope of the invention which is intended to be limited only by the scope of the claims.

What is claimed is:

1. A device that is releasably attachable to a flashlight top lamp end comprising:

a. a shell with a closed top and open bottom said open bottom is adapted to be releasably attachable to and to receive light from the top lamp end of the flashlight, and said shell having a front and a back; and, b. a clear window in the front of said shell; and, c. a flat mirror reflector attached to the shell which directs light from the open bottom of the shell to said window.

2. A device as in claim 1 further comprising:

a. a shield that covers and protects the window and does not block out a sufficient portion of the light from a flashlight that is attached to said shell.

3. A device as in claim 2 wherein:

a. the shield is releasably attachable to the shell.

4. A device as in claim 2 further comprising:

a. a hook attached to the top of the shell which is adapted to be of sufficient strength so that when it hooks over an object it will hold the device and the flashlight attached.

5. A device as in claim 4 further comprising:

a. a magnet attached to the back of the shell that is of sufficient strength that when it is placed against an iron or steel surface it will hold the invention and the flashlight attached.

6. A device as in claim 5 wherein:

a. the hook is hingeable and can either be in an up position for hooking the device with the flashlight attached to an object or in a down position where it lays against the top of the shell.

7. A device attachable to a flashlight comprising:

a. a shell with a closed top and open bottom said open bottom adapted to be releasably attachable to the flashlight and said shell has a front and back; and, b. a window in the front of said shell; and c. a means for directing light from the flashlight through the window; and, d. a hingable hook that can either be in an up position for hooking the device with the flashlight attached to an object or in a down position where it lays against the top of the shell; and, e. a top magnet that is attached to the top of the shell that is of sufficient strength so that when it is placed against an iron or steel surface it will hold the device with the flashlight attached and said magnet has a notch in it so that when the hingable hook is in the down position the hook will not interfere with the attaching of the top magnet to a iron or steel surface.

8. A device as in claim 7 further comprising:

a. a magnet attached to the back of the shell that is of sufficient strength that when placed against an iron or steel surface it will hold the invention and the flashlight attached.

9. A device as in claim 7 further comprising:

a. a shield that covers and protect the window and does not block a sufficient portion of the light from the flashlight that is attached to said shell.

10. A device as in claim 7 wherein:

a. the means for directing light is a mirror.

* * * * *